US007039966B1

(12) United States Patent
Cranston, Jr.

(10) Patent No.: US 7,039,966 B1
(45) Date of Patent: May 9, 2006

(54) DETACHABLE SINK SHELF PLATE

(76) Inventor: Sidney C Cranston, Jr., 2134 Florence Ave., Apt. C, Kingman, AZ (US) 86401

( * ) Notice: Subject to any disclaimer, the term of this patent is extended or adjusted under 35 U.S.C. 154(b) by 0 days.

(21) Appl. No.: 10/907,736

(22) Filed: Apr. 13, 2005

(51) Int. Cl.
*E03C 1/042* (2006.01)

(52) U.S. Cl. ..... 4/695

(58) Field of Classification Search ..... 4/695, 4/696, 675–678; 137/356, 359, 606, 801; 248/56, 57, 70; 285/189, 193
See application file for complete search history.

(56) References Cited

U.S. PATENT DOCUMENTS 1,202,222 A * 10/1916 Quinn ..... 4/695
1,667,124 A * 4/1928 Liniger ..... 285/23
4,760,861 A 8/1988 Botnick
5,465,749 A * 11/1995 Sauter et al. ..... 137/315.15
5,518,016 A 5/1996 Sharwark
5,725,008 A * 3/1998 Johnson ..... 137/15.17
6,158,066 A * 12/2000 Brown et al. ..... 4/695
6,161,230 A 12/2000 Pitsch
6,293,322 B1 9/2001 Wilson-South
2002/0120984 A1 9/2002 Gray et al.
2003/0062087 A1 4/2003 Burns et al.
2003/0221254 A1 12/2003 McNerney et al.

* cited by examiner

*Primary Examiner*—Justine R. Yu
*Assistant Examiner*—Huyen Le

(57) ABSTRACT

A removable sink plate is disclosed for the improved and simplified process of sink faucet installation and or repair. The sink faucet will be attached to the plate. The plate, in turn, will be fastened to the sink using common fasteners such as spring clips, adhesives, etc. A gasket may be used to eliminate the possibility of fluid leakage between the plate and the sink.

4 Claims, 5 Drawing Sheets

FIG. 1B

DETACHABLE SINK SHELF PLATE

BACKGROUND

1. Field of the Invention

This invention relates to sinks, specifically to an improved design that makes it easier to install faucets.

2. Description of Prior Art

The installation of a faucet onto a sink should be a simple task. Unfortunately, the space permitted between a sink basin and the wall is limited. This space limitation makes the assembly more difficult. The watertight compression fittings need to be tightened with a wrench in an area where maneuvering room is barely available. This preliminary obstacle has been overcome recently.

U.S. Pat. No. 5,518,016 to Sharwark (1996) discloses a method of mounting a water faucet without having to work in the enclosed area under the sink. Unfortunately, this method requires modification to both the sink and the faucet. If someone wants to install a new faucet and use the existing sink, this would pose a problem since the faucet described by Sharwark would have additional holes that could not be utilized by the installer. These holes may be considered to be unsightly and would easily fill up with dirt, food particles, or other residue commonly found in a sink area. Likewise, if someone needs to replace the sink but wants to continue using the same faucet, they cannot take advantage of the Sharwark invention. Additionally, the bolt heads securing the faucet to the sink are visible to anyone using the sink. The visibility of the bolt heads not only detract from the aesthetics of the faucet, they also provide unwanted crevices where food or dirt may collect. Likewise, this will make it more difficult to clean the sink faucet area.

U.S. Pat. No. 5,465,749 to Sauter et al. discloses a top mounted faucet assembly composed of a clamping mechanism that is drawn tight using screws accessed from the top side of the work area. While effective, this invention requires the faucet to be modified and therefore eliminates a large segment of the consumer market that may want to repair a faucet or replace the sink only. Additionally, the clamps, hinges, screws and associated hardware add many components that complicate the assembly.

U.S. Pat. No. 2003/0221254 to McNerney et al. (2003) discloses a mounting plate that allows the faucet installer to work above the sink. The mounting plate that this patent teaches is only one portion of a more complex manifold with multiple moving parts similar to the Sauter patent (5,465,749) mentioned above. The manifold cannot be used universally for all types of faucet applications available on the market today. Other disadvantages to using this invention include complexity of design and cost of manufacture.

SUMMARY

The present invention is defined by the appended claims with specific embodiments being shown in the attached drawings. For the purpose of summarization, the present invention allows a sink faucet to be installed from above the sink ledge simply and inexpensively.

In this invention, the faucet is attached to the detachable sink shelf plate using common fasteners. The flexible water lines are then attached to the faucet. The sink plate is then mated to the sink, thereby completing the installation.

The foregoing has outlined rather broadly the more pertinent and important features of the present invention in order that the detailed description that follows may be better understood and that the present contribution to the art can be more fully appreciated. Additional features of the invention will be described hereinafter, which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

OBJECTS AND ADVANTAGES

Accordingly, besides the objects and advantages of the detachable sink shelf plate described above, several objects and advantages of the present invention are:

(1) to provide an assembly that will allow for the simplified above-the-sink installation for any commercially available faucet.

(2) to provide an assembly that will not require any faucet modification in accomplishing the task of faucet installation.

(3) to provide an assembly that minimizes the number of parts and simplifies the overall clamping mechanism.

(4) to provide an assembly that will not introduce any unsightly excess hardware such as bolt heads.

(5) to provide an assembly that is compatible with existing sinks and faucets without modifications to either the sink or the faucet (see alternative embodiment).

(6) to provide an assembly that is interchangeable in the event that the user wants a different number of holes for faucet mounting. For example, only one hole is needed for several late model faucets while some others require up to four mounting holes.

(7) to provide an assembly that allows the faucet installation process to be very similar to what is common in the field today. The current invention does not introduce a multitude of additional (and thereby unfamiliar) components to cause confusion during assembly.

Further objects and advantages will become apparent from a consideration of the ensuing description and drawings.

DRAWING FIGURES

REFERENCE NUMERALS IN DRAWINGS

Figure 1A:
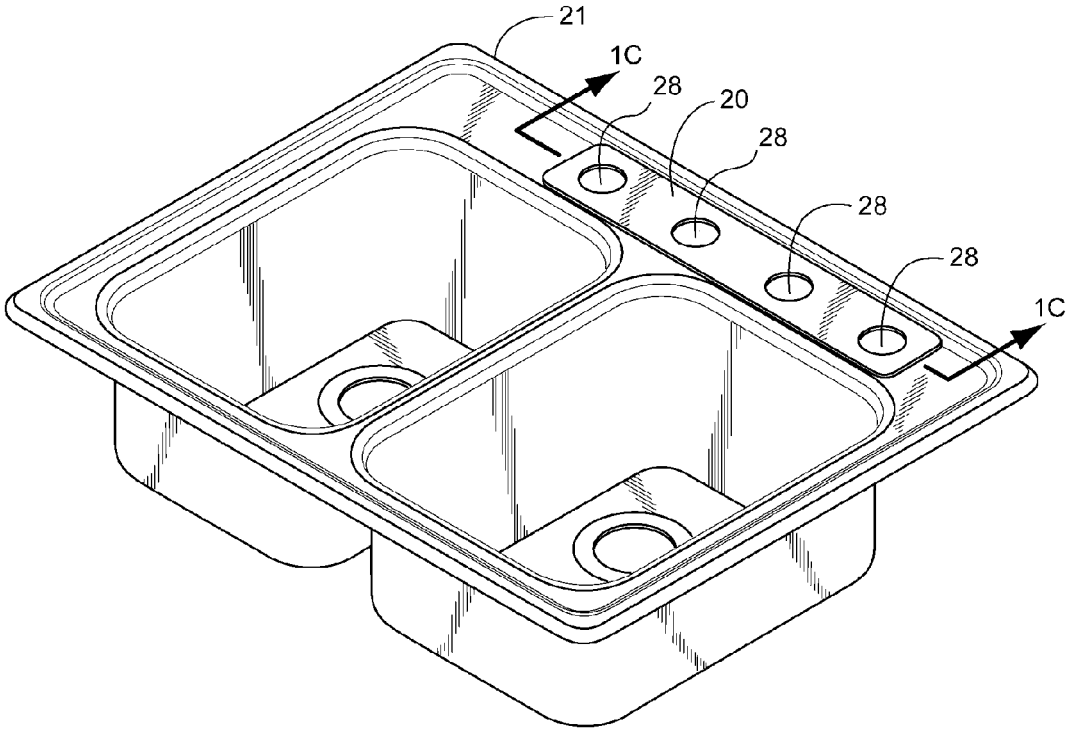
FIG. 1A is a front, top perspective view of the preferred embodiment with the sink shelf plate attached to the sink basin.
Figure 1B:
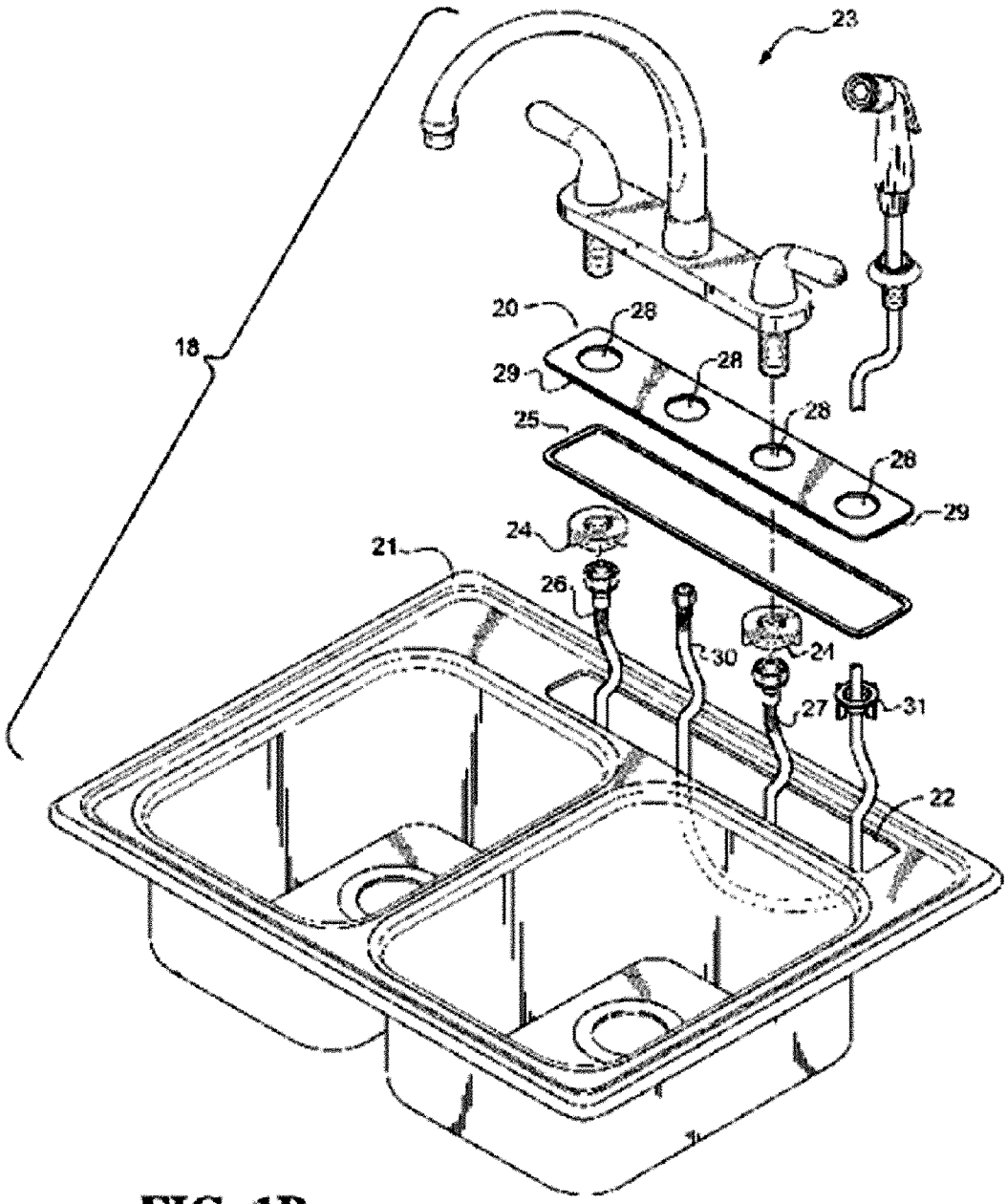
FIG. 1B is an exploded view of FIG. 1 shown with common faucet accessories.
Figure 1C:
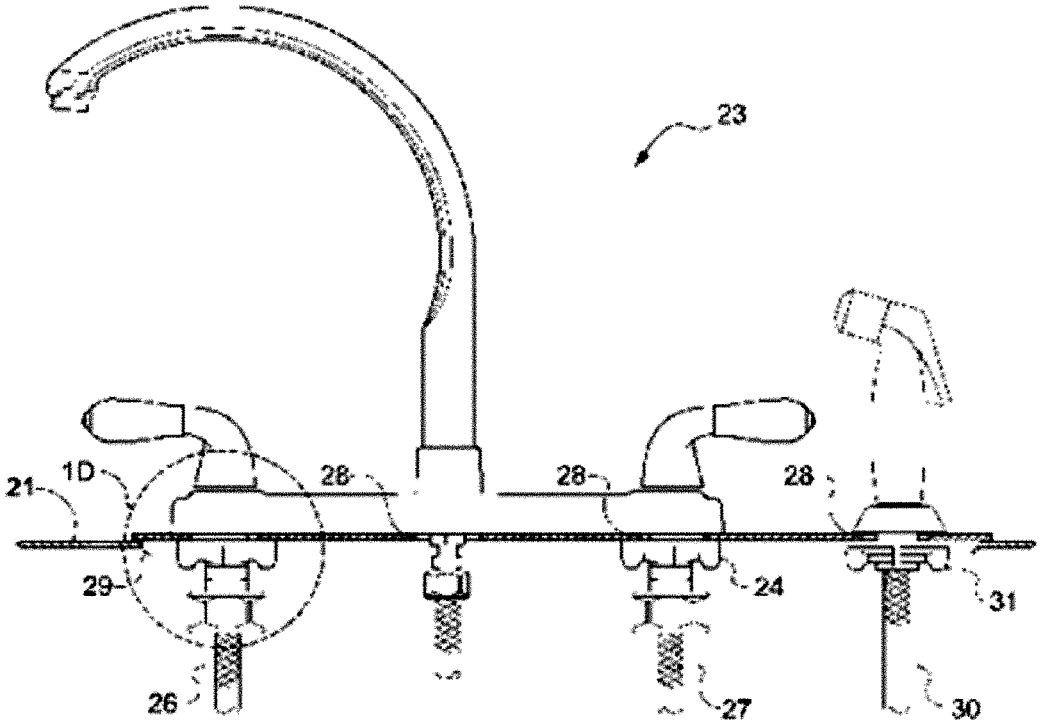
FIG. 1C is a sectional view taken of FIG. 1A.
Figure 1D:
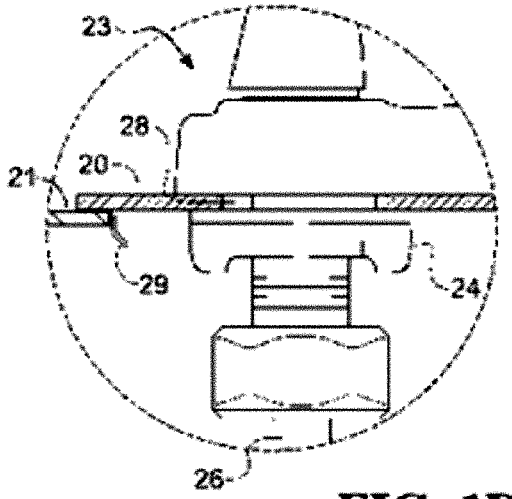
FIG. 1D is a close up detail view of a portion of FIG. 1C.
Figure 1E:
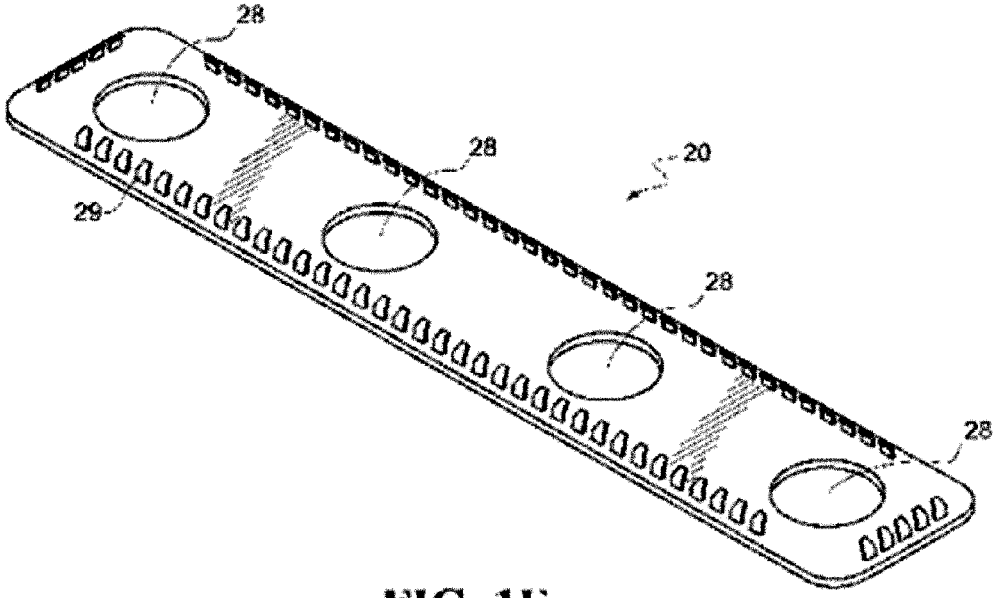
FIG. 1E is a front, bottom perspective view of the preferred embodiment of the sink shelf plate without any other components.

18 preferred embodiment assembly with faucet
19 alternative embodiment assembly without faucet
20 sink plate, preferred embodiment
21 sink basin

22 sink plate opening
23 faucet
24 faucet mounting nuts
25 sink plate gasket (optional)
26 flexible, hot water supply line
27 flexible, cold water supply line
28 faucet mount hole
29 spring clip tines
30 spray accessory line
31 spray accessory nut
32 sink plate, alternative embodiment
33 hole plug, with through hole

DESCRIPTION-FIGS. 1A, 1B, 1C, 1D, 1E-PREFERRED EMBODIMENT

Referring to FIGS. 1A, 1B, 1C, 1D and 1E, a preferred embodiment of a sink plate according to the invention is indicated generally by the reference numeral 20. The sink plate 20 is adapted to be placed atop a sink basin 21 and to overlie a sink plate hole or opening 22 formed in the sink basin. The sink plate opening 22 is located centrally in the faucet shelf area of the sink basin 21 through which access may be had to conventional water conveying conduits 26, 27, and 30.

The sink plate 20 is bilaterally symmetrical and includes four equal sized faucet mount holes or openings 28 aligned along a longitudinal axis of the sink plate 20. The sink plate 20 is chamfered at each corner primarily for cosmetic purposes.

A series of spring clips 29 are attached to the underside of sink plate 20 along each edge. A faucet 23 of essentially standard design is mounted to the sink plate 20 using conventional means that does not deviate from ordinary, common practice.

FIGS. 2, 3-ADDITIONAL EMBODIMENTS

Figure 2:
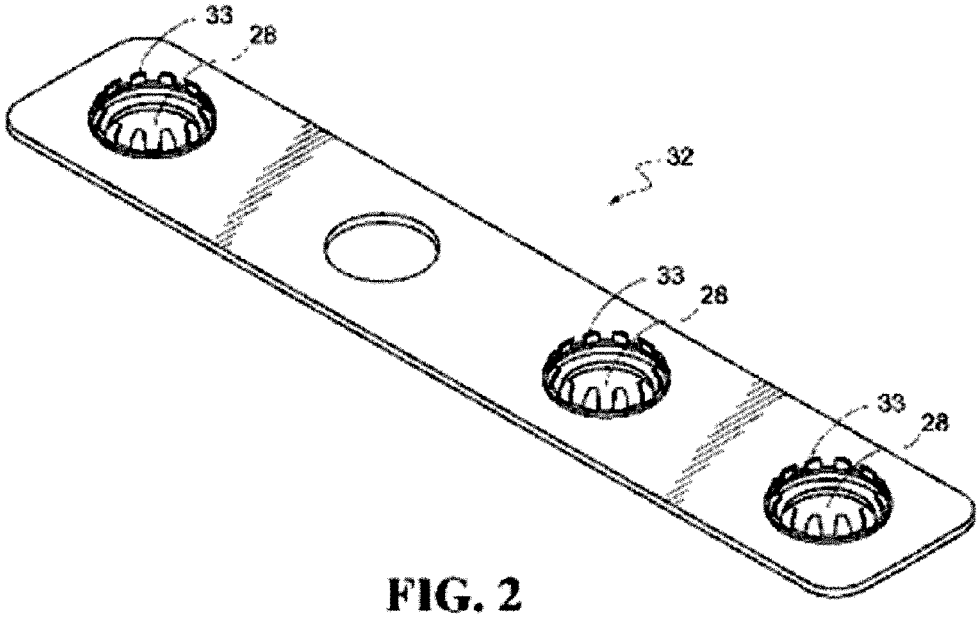
FIG. 2 is a front, bottom perspective view of the alternative embodiment of the sink shelf plate.
Figure 3:
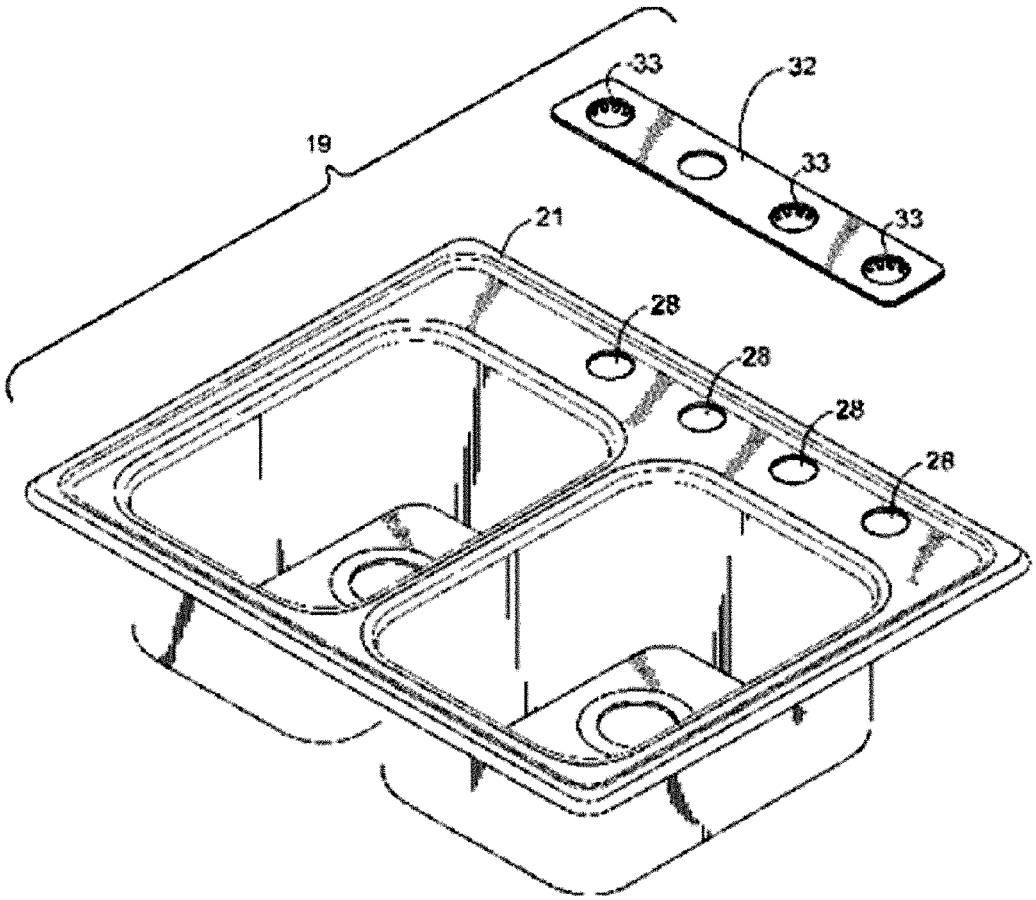
FIG. 3 is a front, top perspective view of the alternative embodiment demonstrating how the sink plate mates with a conventional sink basin.

An additional embodiment is shown in FIGS. 2 and 3. This embodiment employs a somewhat different mating concept which allows the same art to be retrofitted to sinks that are common in today's market. FIG. 2 depicts the sink plate 32 with standard hole plugs 33 that have been drilled with through holes 28. The hole plugs 33 are manufactured by Stimpson Company (part #D3632) and others. The hole plugs 33 are mounted appropriately on the sink plate 32 to mate with the faucet mount holes 28 on the typical sink basin 21 as seen in FIG. 3.

What is claimed is:

1. A faucet mounting assembly for a sink comprising:

a basin which has a top surface and at least one basin mounting hole;

a faucet;

a mounting plate which is removably attached to said top surface of said basin to cover said at least one basin mounting hole to allow said faucet to be connected to said mounting plate prior to attachment to said basin, wherein said mounting plate has faucet mounting holes, and said mounting plate is attached said at least one basin mounting hole by a plurality of spring clip tines extending from an underside of said mounting plate.

2. The faucet mounting assembly of claim 1 wherein said mounting plate has three faucet mounting holes.

3. The faucet mounting assembly of claim 2 wherein said at least one basin mounting hole is three basin mounting holes and said spring clip tines are attached to said mounting plate around the circumference of at least one of said three faucet mounting holes for mounting said mounting plate to said basin.

4. A faucet mounting assembly for a sink comprising:

a basin which has a top surface and at least one basin mounting hole;

a faucet;

a mounting plate having faucet mounting holes which is removably attached to said top surface of said basin to cover said at least one basin mounting hole and to allow said faucet to be connected to said mounting plate prior to attachment to said basin wherein said mounting plate has a faucet mounting side and an opposing underside with a plurality of spring clip tines attached to and extending from said underside for mounting said mounting plate to said basin ; and said faucet is attached to said faucet mounting side of said mounting plate through said faucet mounting holes.

* * * * *